United States Patent [19]

Sher

[11] Patent Number: 4,982,857

[45] Date of Patent: Jan. 8, 1991

[54] EXPANSIBLE GARBAGE CAN FOR CLASSIFICATION OF GARBAGES

[76] Inventor: Cheng-Hsien Sher, No. 18, Lane 195, Nan Tai Rd., Kauhsiung City, Taiwan

[21] Appl. No.: 516,947

[22] Filed: Apr. 30, 1990

[51] Int. Cl.[5] ..... B65D 9/00

[52] U.S. Cl. ..... 220/8; 220/908; 220/527; 220/8

[58] Field of Search ..... 220/8, 1 T, 22.1, 22, 220/21, 4 A

[56] References Cited

U.S. PATENT DOCUMENTS

| | | | |
|---|---|---|---|
| 2,953,244 | 9/1960 | Phillips | 220/8 |
| 3,140,777 | 7/1964 | Gordan | 220/8 |
| 4,216,927 | 8/1980 | Byrd | 220/8 |
| 4,509,656 | 4/1985 | Rosler | 220/8 |

FOREIGN PATENT DOCUMENTS

| | | | |
|---|---|---|---|
| 128918 | 10/1948 | Australia | 220/8 |

*Primary Examiner*—Joseph Man-Fu Moy

*Attorney, Agent, or Firm*—Varndell Legal Group

[57] ABSTRACT

An expansible garbage can, which comprises a main case having two side frames expansibly connected thereto at its front and rear sides. It can be flexibly arranged either in a single-bin status with the rear side frame and the main case received inside the front side frame, or in a double-bin status with the main case received inside the rear side frame, or in a triple-bin status with the main case, the rear side frame and the front side frame in an extended condition.

4 Claims, 3 Drawing Sheets

EXPANSIBLE GARBAGE CAN FOR CLASSIFICATION OF GARBAGES

BACKGROUND OF THE INVENTION

The present invention is related to garbage cans and more particularly to an expansible garbage can for classification of garbages.

In recent years, refuse disposable has become a common environmental problem of every city government in the world, and environmental protection has become a common responsibility of the citizen. In order to prevent from causing secondary pollution during refuse disposal, it is very important to collect garbages according to classification, i.e. to collect similar garbages separately. For example, combustible garbages shall be separated from incombustible garbages or waste chemicals. However, according to regular methods, it may require several garbage cans to collect different types of garbages.

SUMMARY OF THE INVENTION

The present invention has been accomplished under the circumstances in view. It is an object of the present invention is to provide an expansible garbage can in which the receiving space can be adjusted according to the quantity of garbages received.

Another object of the present invention is to provide an expansible garbage can which is expansible to provide one to three receiving spaces for collecting garbages according to pre-determined classification.

Still another object of the present invention is to provide an expansible garbage can which has a suspension gear for hanging waste water bags.

Still another object of the present invention is to provide an expansible garbage can which minimizes space occupation.

Still another object of the present invention is to provide an expansible garbage can which helps imparting the concept of the classification of garbages on the people.

Still another object of the present invention is to provide an expansible garbage can which provides a sense of beauty when it is placed in a kitchen for collecting garbages.

Still another object of the present invention is to provide an expansible garbage can which is inexpensive to manufacture.

A yet further object of the present invention is to provide an expansible garbage can which can efficiently expel vermin.

BRIEF DESCRIPTION OF THE DRAWINGS

The present invention will be understood from the following detailed description of preferred embodiments of this invention with reference to the annexed drawings, in which.

Figure 2:
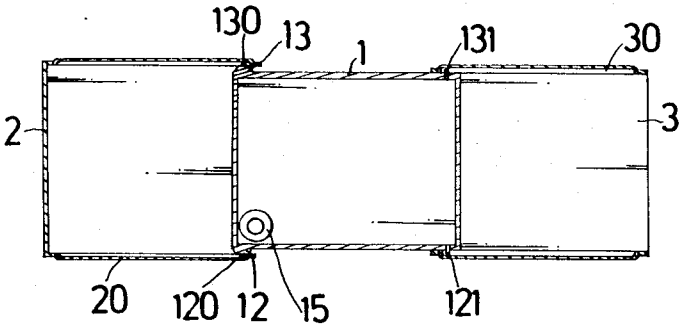
FIG. 2 is a top view thereof.
Figure 1:
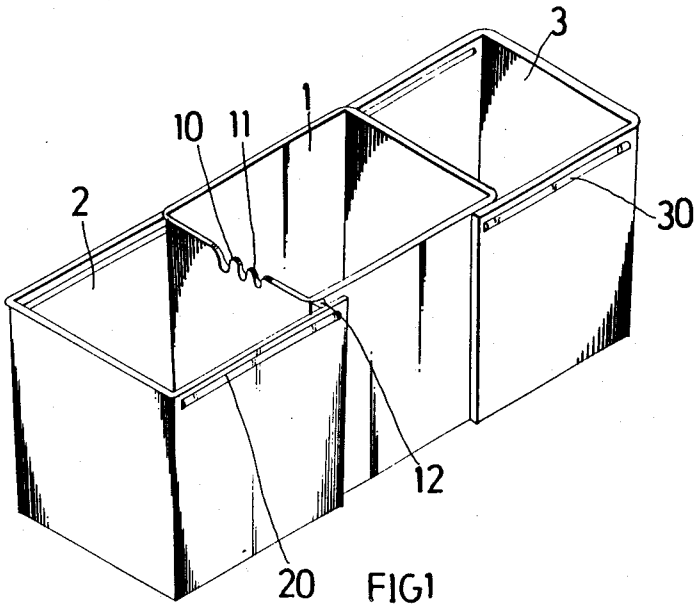
FIG. 1 is a perspective view of an expansible garbage can embodying the present invention.

DETAILED DESCRIPTION OF THE PREFERRED EMBODIMENTS:

Referring to FIGS. 1 and 2, an expansible garbage can in accordance with the present invention is generally comprised of a main case 1 and two side frames 2, 3. Two toothed portions 10, 11 are formed on the topmost edge of the main case at its one side for hanging waste water bag or container. A small container holder 15 is made inside the main case 1 at one corner for receiving camphor balls or other chemicals to expel vermin. Two elongated raised portions 12, 13 are made on the main case 1 bilaterally at the two opposite edges of its front side. Two bolts 120, 130 respectively extend outward from the top ends of the two elongated raised portions 12, 13. Another two bolts 121, 131 bilaterally extend outward from the two opposite edges of the back side of the main case 1. The rear side frame 3 comprises two opposite, elongated grooves 30 on its two opposite side walls at positions corresponding to the repair pair of bolts 121, 131. The front side frame 2 comprises two opposite, elongated grooves 20 on its two opposite side walls at positions corresponding to the front pair of bolts 120, 130. During assembly, the rear side frame 3 is sleeved on the main case 1 from its rear side permitting the rear pair of bolts 121, 131 to respectively set in the two opposite, elongated grooves 30 of the rear side frame 3, and then, the front side frame 2 is sleeved on the main case 1 from its front side permitting the front pair of bolts 120, 130 to respectively set in the two opposite, elongated grooves 20 of the front side frame 2. By means of the said arrangement, the main case 1 can be moved inside the rear side frame 3 or the front side frame 2, and the rear side frame 3 as well as the main case 1 can be simultaneously moved in or out of the front side frame 2. Because of the design of the raised portions 12, 13, the relative motion of the main casel, the front side frame 2 and the rear side frame 3 will not be interfered with one another.

Figure 3:
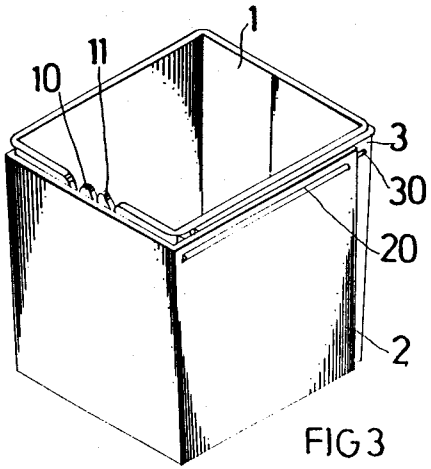
FIG. 3 illustrates the garbage can arranged in a single-bin status.
Figure 5:
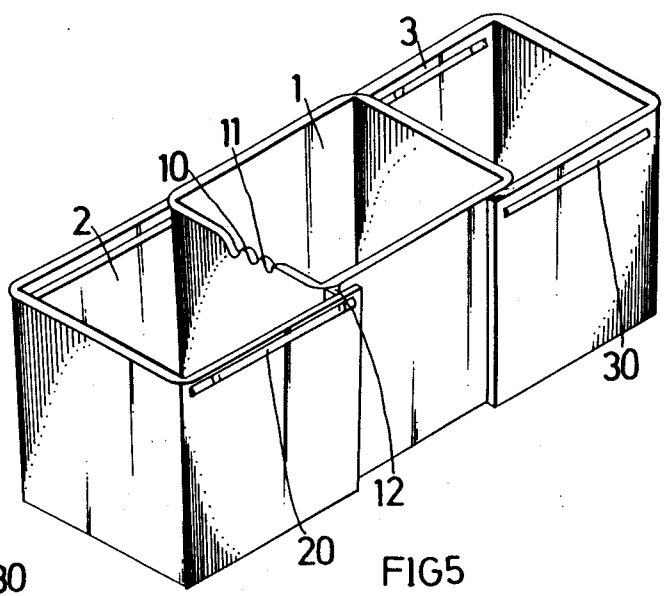
FIG. 5 illustrates the garbage can arranged in a fully expanded triple-bin status.
Figure 4:
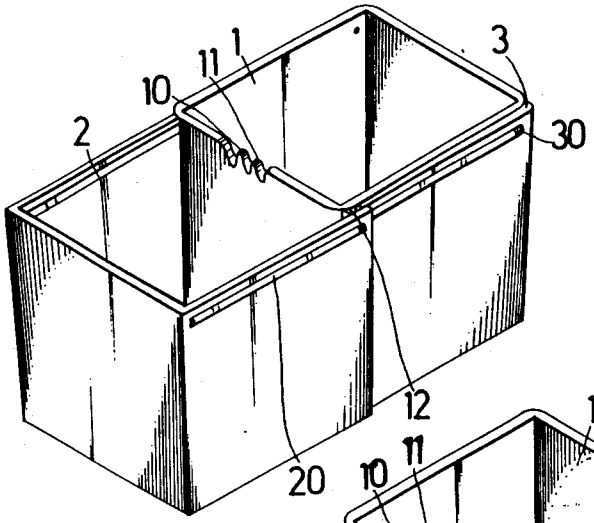
FIG. 4 illustrates the garbage can arranged in a double-bin status.

Referring to FIGS. 3 through 5, the above described embodiment of expansible garbage can be placed anywhere, either at one's home or office, for collection garbages. It can be flexibly arranged either in a single-bin status with the rear side frame 3 and the main case 1 received inside the front side frame 2 (as shown in FIG. 3) or in a double-bin status with the main case 1 received inside the rear side frame 3 (as shown in FIG. 4), or in a triple-bin status with the main case, the rear side frame 3 and the front side frame 2 in an extended condition (as shown in FIG. 5).

Figure 6:
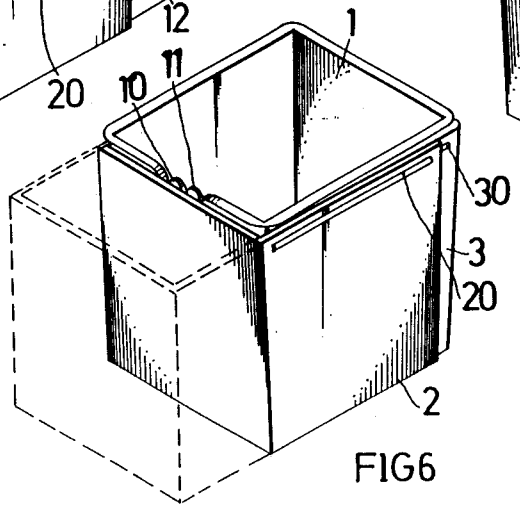
FIG. 6 illustrates an arrangement to partly expand the front side frame from the main case.
Figure 7:
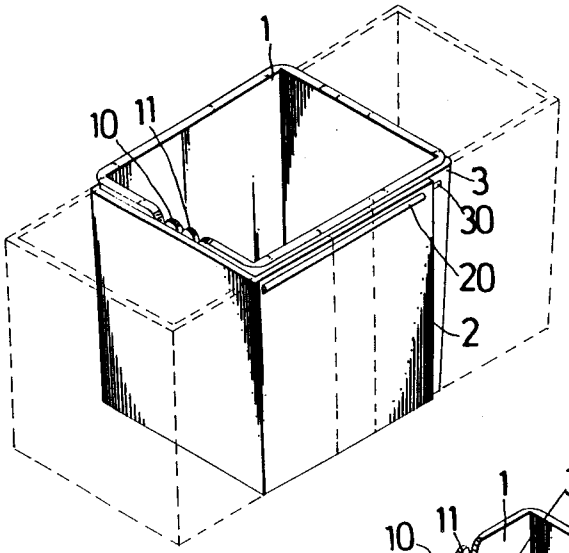
FIG. 7 illustrates an arrangement to partly expand the front and rear side frames from the main case.
Figure 8:
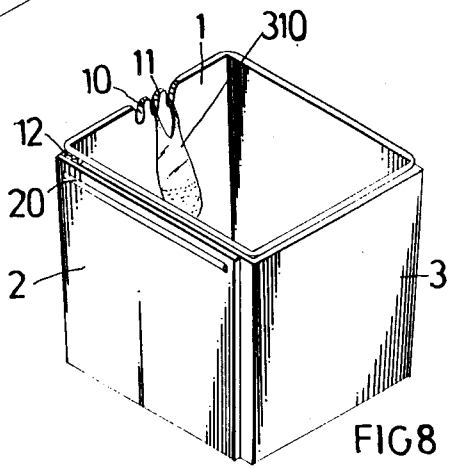
FIG. 8 illustrates a waste water bag hanging on the toothed portions of the main case.

Referring to FIGS. 6 through 8, the receiving space of the expansible garbage can can also be flexibly adjusted according to the quantity of garbages received. The main case 1 may be received inside the rear side frame 3 with the front side frame 2 partly extended out of the main case 1 (see the dotted line in FIG. 6), or the front side frame 2 as well as the rear side frame may be partly extended out of the main case 1 (see the dotted line in FIG. 7). In addition, waste water bag 310 may be hung on the toothed portions 10, 11 of the main case 1 (see FIG. 8) to prevent from permeation of waste water into collected garbages.

Figure 9:
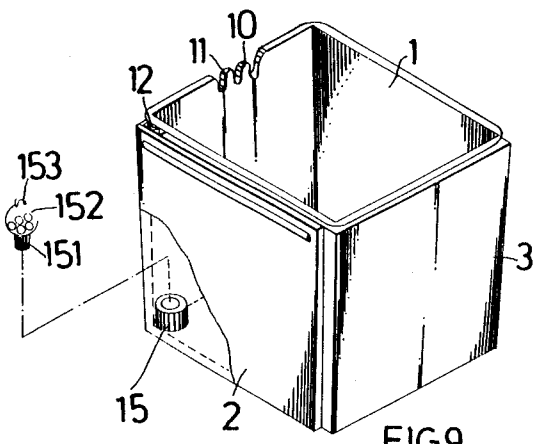
FIG. 9 illustrates the structure of the pillbox and the container holder.
Figure 10:
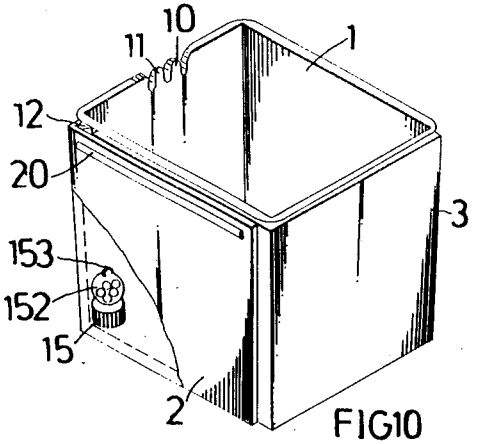
FIG. 10 illustrates the positioning of the pillbox in the container holder.

Since refuse dump tends to form into a breeding ground for flies, mosqitoes and other vermin, this condition must be taken into account during garbage disposal. This problem can be eliminated according to the present invention. As shown in FIGS. 9 and 10, a container holder 15 is mounted inside the main case 1 at one corner thereof for the fastening therein of a circular pillbox 150. The pillbox 150 has a round-shaped hollow body 152 for receiving camphor balls or other chemicals to expel vermin, a bottom shaft 151 extending downward from its round-shaped body 152 for fastening in the container holder 15, and a handhold 153 on the top of its round-shaped body 152 for the holding of the hand to lift it away from the container holder 15.

As is apparent from the foregoing specification, the invention is susceptible of being variously embodied. Recognizing various modification been apparent, the scope herein shall be deemed as defined in the claims set forth hereinafter.

I claim:

1. An expansible garbage can, comprising:

a main case having two elongated raised portions bilaterally vertically on the two opposite edges of its front side with a front pair of bolts bilaterally extending outward from the top ends of said two elongated raised portions, and a rear pair of bolts bilaterally extending outward from the two opposite edges of its back side;

a front side frame movable connected to said main case at the front side and having two opposite, elongated grooves on its two opposite side walls for the sliding therein of the front pair of bolts of said main case; and a rear side frame movably connected to said main case at the back side and having two opposite elongated grooves on its two opposite side walls for the sliding therein of the rear pair of bolts of said main case;

characterized in that the garbage can can be flexibly arranged either in a single-bin status with said rear side frame and said main case received inside said front side frame or in a double-bin status with said main case received inside the rear side frame, or in a triple-bin status with said main case, said rear side frame and said front side frame in an extended condition.

2. An expansible garbage can as claimed in claim 1, wherein said main case has two toothed portions made on the topmost edge of its front side for hanging waste water bag.

3. An expansible garbage can as claimed in claim 1, wherein a small container holder is made on the inner bottom of said main case at one corner, defining a conical hole at its center for the fastening therein of a pillbox.

4. An expansible garbage can as claimed in claim 3, wherein said pillbox has a round-shaped hollow body for receiving camphor balls or other chemicals to expel vermin, a bottom shaft extending downward from its round-shaped body for fastening in the conical center hole of said container holder, and a handhold on the top of its round-shaped body for the holding of the hand to conveniently lift it away from said container holder.

* * * * *